US010092909B2

(12) United States Patent
Chezaud et al.

(10) Patent No.: US 10,092,909 B2
(45) Date of Patent: Oct. 9, 2018

(54) CENTRIFUGAL SEPARATOR WITH CONES DIVIDED INTO ANGULAR SECTORS SEPARATED BY ANNULAR GAPS

(71) Applicants: Commissariat à l'énergie atomique et aux énergies alternatives, Paris (FR); Flowersep, La Farlede (FR)

(72) Inventors: David Chezaud, Lacepede (FR); Jean-Pierre Feraud, Orange (FR); Joël Robin, La Farlede (FR); Tojonirinia Randriamanantena, Bagnols sur Ceze (FR)

(73) Assignees: COMMISSARIAT A L'ENERGIE ATOMIQUE ET AUX ENERGIES ALTERNATIVES, Paris (FR); FLOWERSEP, La Farlede (FR)

( * ) Notice: Subject to any disclaimer, the term of this patent is extended or adjusted under 35 U.S.C. 154(b) by 698 days.

(21) Appl. No.: 14/409,640

(22) PCT Filed: Jun. 27, 2013

(86) PCT No.: PCT/EP2013/063550
§ 371 (c)(1),
(2) Date: Dec. 19, 2014

(87) PCT Pub. No.: WO2014/001469
PCT Pub. Date: Jan. 3, 2014

(65) Prior Publication Data

US 2015/0148213 A1 May 28, 2015

(30) Foreign Application Priority Data

Jun. 29, 2012 (FR) ..... 12 56276

(51) Int. Cl.
*B04B 1/08* (2006.01)
*B04B 7/14* (2006.01)
(Continued)

(52) U.S. Cl.
CPC ..... *B04B 1/08* (2013.01); *B04B 7/14* (2013.01); *B04B 11/02* (2013.01); *B04B 11/08* (2013.01)

(58) Field of Classification Search
CPC ..... B04B 1/08; B04B 11/08; B04B 11/02; B04B 7/14; B21D 22/16
(Continued)

(56) References Cited

U.S. PATENT DOCUMENTS 663,113 A * 12/1900 Berrigan ..... B04B 1/08 494/64
3,519,070 A * 7/1970 Bappler ..... F28F 1/36 165/133
(Continued)

FOREIGN PATENT DOCUMENTS

GB 263 443 12/1926
JP 369327 U 9/1949
(Continued)

OTHER PUBLICATIONS

French Search Report issued in corresponding Application No. FR 12 56276 dated May 7, 2013.
(Continued)

*Primary Examiner* — Charles Cooley
(74) *Attorney, Agent, or Firm* — Pearne & Gordon LLP

(57) ABSTRACT

The rotary bowl (1) of this centrifugal separator is lined with conical structures divided into sectors (7) separated by angularly offset gaps (9) so as to promote a regular spiral fluid flow therein, which is laminar and enhances separation efficiency significantly: in the case of two-phase or three-phase suspensions, a "cake" is obtained on the side wall (8). A scraper (15) rotating at a slightly different speed may be added to enable simultaneously routing of the solid cake to the outlet and continuous processing.

17 Claims, 5 Drawing Sheets

(51) Int. Cl.
*B04B 11/08* (2006.01)
*B04B 11/02* (2006.01)

(58) Field of Classification Search
USPC ..... 494/67–73
See application file for complete search history.

(56) References Cited

U.S. PATENT DOCUMENTS

| | | | | |
|---|---|---|---|---|
| 4,258,782 | A * | 3/1981 | Kao | F28F 1/12 138/38 |
| 4,361,490 | A | 11/1982 | Sagat | |
| 4,478,718 | A | 10/1984 | Sagat | |
| 4,826,089 | A * | 5/1989 | Psaltopoulos | B01F 5/0616 241/154 |
| 9,687,858 | B2 * | 6/2017 | Quiter | B04B 7/14 |
| 2008/0232190 | A1 * | 9/2008 | Schneider | B01F 5/0619 366/337 |
| 2015/0148213 | A1 * | 5/2015 | Chezaud | B04B 1/08 494/37 |

FOREIGN PATENT DOCUMENTS

| | | | |
|---|---|---|---|
| JP | S4618550 | A | 6/1971 |
| JP | S5520684 | A | 2/1980 |
| JP | S5673565 | A | 6/1981 |
| JP | 200436905 | A | 2/2004 |
| WO | 2007/133161 | A1 | 11/2007 |
| WO | 2009/005355 | A1 | 1/2009 |
| WO | 2011/028122 | A1 | 3/2011 |
| WO | 2011/053224 | A1 | 5/2011 |
| WO | 2012/025416 | A2 | 3/2012 |
| WO | 2012/033440 | A2 | 3/2012 |

OTHER PUBLICATIONS

International Search Report issued in Application No. PCT/EP2013/063550 dated Aug. 20, 2013.
Written Opinion issued in corresponding Application No. FR 12 56276 dated Jun. 29, 2012.

* cited by examiner

CENTRIFUGAL SEPARATOR WITH CONES DIVIDED INTO ANGULAR SECTORS SEPARATED BY ANNULAR GAPS

BACKGROUND OF THE INVENTION

The invention relates to a laminar-flow centrifugal separator.

This separator has been devised for fluid mixtures containing solids, liquids or gases in varied proportions, but above all mixtures containing solid suspensions in liquid phases, to be separated into at least one liquid fraction and one fraction containing the solid. Good separation of the constituents of the mixture is then sought and a solid fraction presented in a compact form, or cake, with a relatively low residual suspension liquid content is obtained. Even when the formation of a cake gives rise to a high flow resistance, or a significant sectional reduction thereof, it is generally sought to extract this solid fraction from the separator, and if possible in a continuous fashion despite the compact nature thereof, as it is formed in the rotary bowl, without enabling same to accumulate therein. This aim is not generally achieved with existing separators, many of which require on the contrary periodic process shutdowns, adverse to the yield thereof, to remove the cake. Separators envisaging continuous removal of the solid fraction are not normally suitable for obtaining a sufficient dry content.

Indeed, numerous centrifugal separators exist. Mention is made of the document WO-A-2007/133 161, describing a separator having some superficial resemblances with the invention. It comprises as a main part a biconical rotary bowl wherein separation is performed. The mixture is introduced into the bowl via a hollow conduit, corresponding to the bowl support and rotation axis. The heavier solid fraction is routed to the periphery of the bowl and more particularly into the bulging area corresponding to the cone junction. Opening peripheral bores at this point make it possible to extract said fraction, while the fluid fraction rises towards to the top of the bowl, as the mixture is added, and is discharged via an opening situated at the top of the bowl opposite the feed opening. Conical structures, referred to as dishes, flaring at the bottom and actuated at the same time as the wall of the bowl, occupy most of the inner volume thereof They are used to partition various portions of the mixture and help homogenise the separation conditions inside the bowl. However, this device is not suitable for obtaining a solid fraction that is as homogeneous or compact as that sought, and continuous extraction of this fraction is difficult.

Mention may also be made of the document WO-A-2012/025416, describing a separator wherein the chamber is also occupied by separation dishes, however perforated in places to clear the axial channels favouring axial flow of the fluid load, and the distribution thereof in the stack of dishes. A centripetal movement of the fluid is however imposed in the bowl between radially external inlet orifices and radially internal outlet orifices, which further essentially provides flow channelling in separate parallel streams and thus differs little from the design of the previous document. The fluid is separated from the solid fraction, emerging from the peripheral wall of the bowl via lateral openings and is deposited on an outer screw actuated by this wall. A further rotating wall, but at a slightly different speed, encompasses the screw and retains the solid fraction while allow the screw to run thereon and finally leave the device due to the different rotational speed thereof. Here again, fraction separation is not very effective.

In the field of apparatuses providing a rotating outer enclosure, satisfactory drainage performances are obtained with the equipment from WO-A-2009/005355 and WO-A-2011/028122 integrating an internally lined rotation mode and a barrel-shaped outer enclosure. The internal lining consists of dishes or plates in a spiral arrangement. The use of a laminar flow is never envisaged or mentioned as an enhancement option.

Dish separators have been the subject of enhancements to prevent the accumulation of solid matter and the appearance of unbalance in the centrifuge. One proposed solution consists of perforating the dishes or placing separation disks at the lower and upper part of the lining (WO-A-2012/033440). This type of development relates more particularly to low-concentration liquid and gas treatment (scrubbing).

SUMMARY OF THE INVENTION

The enhancements offered by the invention are essentially dependent on the creation of a regular laminar flow inside the rotary bowl: indeed, it has been observed that a more compact and dryer solid cake was obtained using such a flow, which produces superior phase separation.

One general embodiment of the invention is a centrifugal separator comprising a rotary bowl having a peripheral wall, a separation structure situated in the bowl and rotating synchronously with the bowl, a mixture inlet conduit situated on a rotational axis of the bowl and opening in the bowl, the bowl comprising at least one outlet orifice for liquid or gaseous fractions of the mixture to a first axial side of the bowl, where the separation structure comprises a stack of cones divided into angular sectors forming sectors separated by angular gaps, the angular gaps being covered by the sectors of the immediately adjacent cones, and the sectors have peripheral ends at an identical distance from the peripheral wall.

The discontinuous conical structures consisting of sectors separated by gaps enable regular progressive axial motion of the mixture through same. The fluid flow is much more regular than in prior designs and is essentially performed in a spiral, without sudden changes in direction between the ends of the bowl. The field of the speeds is also much more uniform. The consequence is that a laminar flow may be obtained without difficulty, and that the separation of the fluid fraction and the solid fraction is considerably superior. The latter is deposited on the peripheral wall of the bowl, as usual, and may then be removed. Neither the deposition of the solid fraction nor the optional removal thereof simultaneously with the separation actually disturbs the flow, which remains essentially spiral.

It is advantageous, in order to increase flow regularity, that the peripheral wall of the bowl is defined by a rectilinear generating line in front of the sectors (as opposed to the biconical shape for example), or more preferably that the bowl is cylindrical and the cones are identical with each other.

The invention is generally better implemented when the cake corresponding to the solid fraction can be removed regularly and progressively. It is then recommended that the opening is situated on a second axial side of the bowl, opposite said first side where the fluid fraction emerges, extends over a circumference of the bowl and is adjacent to an edge of a side wall of the bowl. It is then possible to add an inclined scraper through the opening and extending in front of an inner face of the side wall of the bowl; a transmission provides a differential rotational speed between the bowl and the scraper using a single separator drive motor, which requires a low relative speed of the scraper inside the bowl, which performs the sought scraping. The centrifugal separator may be advantageously equipped with two motors, one for rotating the bowl and the other for rotating the solid extraction system. This arrangement makes it possible to control the centrifugal part and the scraper and extraction part independently without differential-related coupling constraints.

BRIEF DESCRIPTION OF THE DRAWINGS

One particular and merely illustrative embodiment of the invention will now be described with reference to the following figures, disclosing the various aspects thereof.

DETAILED DESCRIPTION

Figure 1:
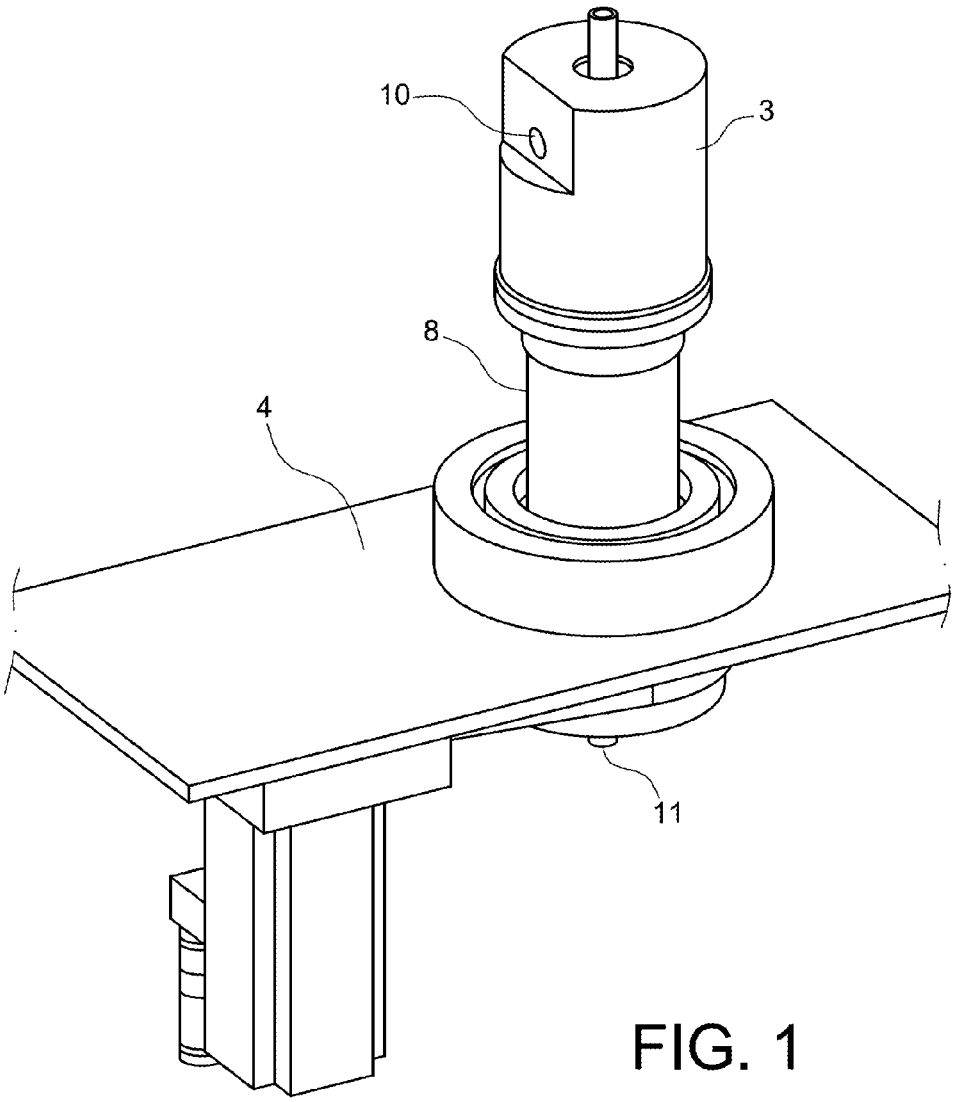
FIG. 1 is an external view of one embodiment of the separator.

The separator comprises a rotary bowl 1, consisting of a cylindrical barrel forming a side wall 8, and a central axis 2. The central axis 2 and the rotary bowl 1 are held between an upper static head 3 and a lower frame 4, which are kept at invariable distances. The mixture is introduced via a conduit 5 contained in the central axis 2, in this case from the top and the static head 3, and reaches the rotary bowl 1 via openings 6 which may be situated at the bottom of the conduit 5 or distributed along the height thereof. The central axis 2 bears conical structures consisting of separate sectors 7 comparable to flowers, superimposed on all or part of the height of the barrel to the liquid recovery manifold 20, and inclined towards the side wall 8 of the rotary bowl 1 and downwards. The sectors 7 are offset at an angle from one stage to another, such that the gaps 9 thereof are covered by an upper sector 7 and that a merely axial flow via the stack of structures is impossible. The liquid fraction of the mixture, obtained by separation and comprising clarified liquid with a low solid content, is discharged from the rotary bowl 1 by a rotating manifold 20 housed in the static head 3 followed by an upper orifice 10. The solid fraction is deposited on the inner face of the side wall 8 before leaving the rotary bowl 1 and emerging from the separator via a lower orifice 11, in the manner described hereinafter.

Figure 2:
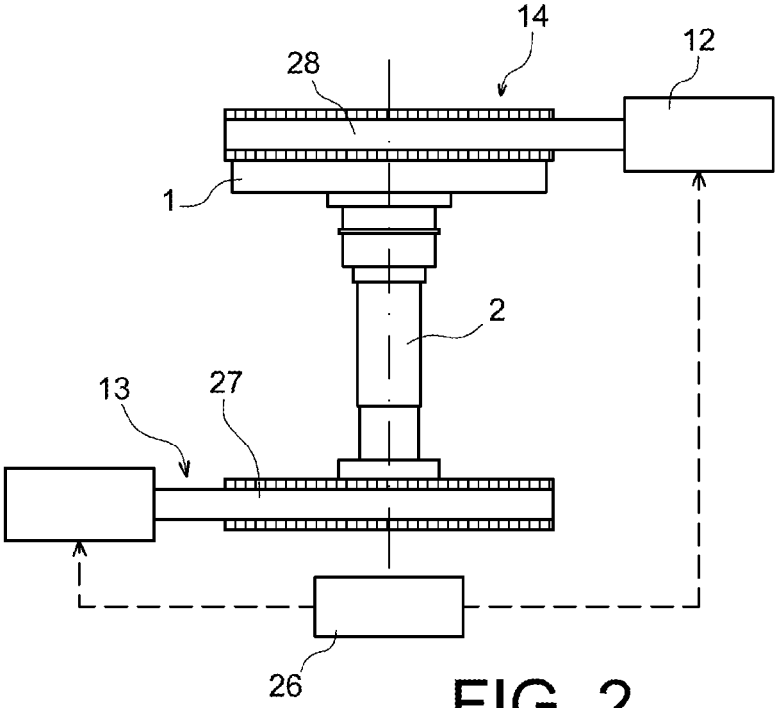
FIG. 2 more particularly discloses the driving parts thereof (in a single-drive motor configuration)

For example, in the embodiment in FIG. 2, a motor 12 rotates an extraction screw 19 and a scraper 15 described hereinafter via a differential 26 and a first transmission 13 comprising a notched belt 27 and toothed wheels. There is also a second transmission 14 driving the rotary bowl 1 (and particularly the side wall 8 thereof, the central axis 2, the manifold 20, the deflector 22 and the sectors 7) at a rotational speed that may be different to that of the scraper 15 and the extraction screw 19 and further comprises a notched belt 28 and toothed wheels. A supporting member 21 supports the weight of the rotary bowl 1 and the central axis 2 while enabling the rotation thereof. This supporting member 21 may be annular with a large diameter in order to support the rotary bowl 1 along the entire periphery thereof. The scraper 15 comprises one or more inclined blades 17, mounted on a common circular supporting member 18 extending inside the rotary bowl 1, along a part of the height thereof, in front of the inner face of the side wall 8. The supporting member 18 extends under an inverted conical base 22 referred to as a deflector, associated with the central axis 2, of the rotary bowl 1; the blades 17 extending via a bottom opening 23 of the rotary bowl 1, between the base 22 and the bottom of the side wall 8, and thus enter therein. As the rotational speed of the scraper 15 is slightly different to that of the rotary bowl 1 when the solids are discharged, the inclination of the blades 17 combined with the movement thereof in the rotary bowl 1 lowers the solid cake progressively down from the separator. It leaves the rotary bowl 1 via the opening 23 and drops onto the conveying screw 19 situated under the supporting member 18, carrying same to the outlet orifice 11.

Figure 3:
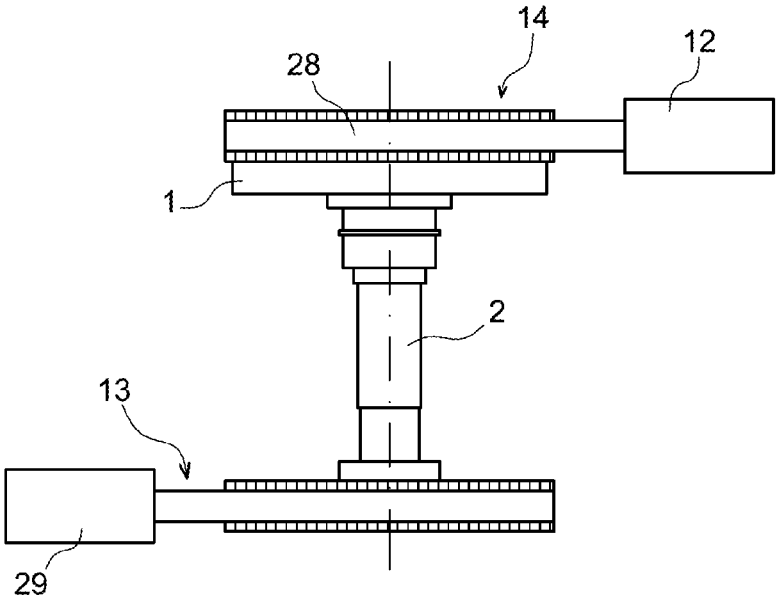
FIG. 3 has a two-drive motor configuration
Figure 4:
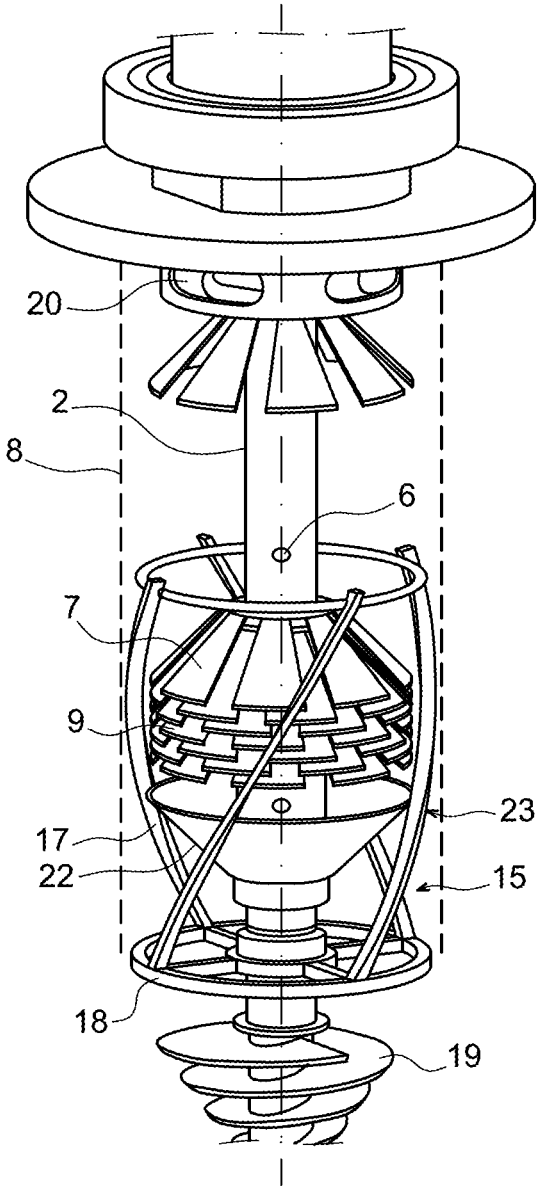
FIG. 4 is a view of the rotary constituents thereof which separate the fractions and remove the cake FIG. 5 further illustrates the separator the overall separator, this time in a sectional view.

In the slightly different embodiment in FIG. 3, two motors 29 and 30 replace the motor 12 and drive the transmissions 13 and 14 at the desired speeds respectively, no differential being required.

Apart from the blades 17 of the scraper 15 and the extraction screw 19 which may rotate at a different speed, the entire contents of the rotary bowl 1 rotate at the same speed and are thus subject to regular conditions, favouring laminar flow. Furthermore, the simple geometric shapes of the side wall 8 and the stacked and angularly offset sectors 7 produce a regular angular flow component. As the flow is regular, the separation of the solid fraction and the fluid fraction is disturbed much less, and the result thereof is thus considerably superior.

The invention makes it possible to obtain high dry content values greater than 65% of the solid fraction according to the nature of the suspensions processed. It may be applied to solids subject to difficult filtration, particularly in crystals in irregular and elongated shapes, examples whereof are actinide oxalate co-precipitates, used in the nuclear industry. It may find applications in other processes in this industry, or, to mention completely different examples, in the food industry, pharmaceuticals, cosmetology, biofuels, the environment, etc. where the solid products are frequently irregularly shaped organic products.

It should be noted that the invention is not limited to the separation of solid-liquid two-phase mixtures where the solid is heavier: it is on the contrary applicable to fluid mixtures of all types and can be used to envisage three-phase separations by adding a third extraction point; the solid fraction mentioned in this description according to the application essentially envisaged is more generally a heavy fraction, and the fluid fraction a light fraction.

The removal of the solid fraction simultaneously with separation is not necessary for the satisfactory operation of the separator, although it enables continuous operation which is very often appreciated; the favourable separation features remain even with significant deposition of the solid fraction.

The invention is equally suitable for repulping solid scrubbing methods, where the solid fraction is resuspended with a solvent and subjected to a second separation to enhance the quality thereof.

The embodiment described herein is suitable for modularity by replacing parts, the rotary bowl 1 and the central axis 2 bearing the sectors 7 particularly being suitable for being replaced readily by other internal linings, of different sizes, different geometries according to requirements.

Figure 6A:
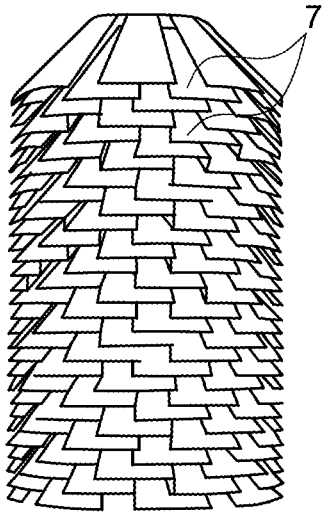
FIGS. 6A, 6B and 6C more particularly represent the lining of the rotary bowl and alternative embodiments.
Figure 6B:
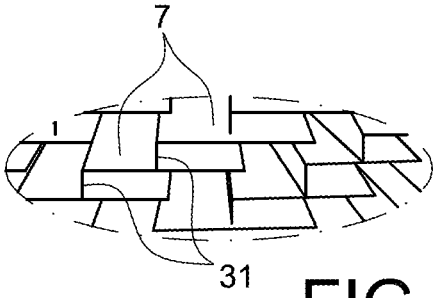
Figure 6C:
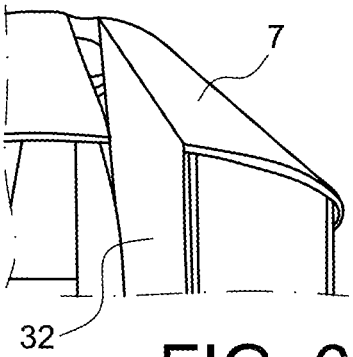

The angular offset of the sectors from one stack to another may depend on the shape thereof and the sought flow features. Further features of the sectors 7 may also be modified: as such, they can be provided with extensions connecting same. FIG. 6A represents a stack of sectors 7 according to the description above, FIG. 6B a stack of sectors 7 wherein the sectors 7 belonging to adjacent stacks are inserts extending axially and radially in the apparatus. Finally, FIG. 6C illustrates further longer extensions 32, likewise extending to a sector 7 of the adjacent stack, but which is in this case at a greater distance. The extensions 31 or 32 are used for superior rotation of the mixture and help circulate the liquid fraction via a regular spiral path; the partitioning introduced thereby barely changes the flow.

The sectors 7 may be made of metal or reinforced plastic for example. The deformation thereof under centrifugal forces is frequently acceptable, and it may be reduced by shims or spacers.

Of the various enhancements and modifications that can be made to the separator, the following may be noted.

The sectors 7 of adjacent cones may be successively angularly offset, producing a satisfactory helical flow component for routine cone gap values.

Calibrated spacers 33 may separate the cones, by being for example fitted in alternation therewith on the central axis 2, with the ability to vary the cone distance. A spring 34 may be arranged in the stack of cones, for example between the upper cone and the manifold 20. This spring 34 may be a lock washer or any other device with the same purpose.

In order to keep constant distances between the stacked sectors 7, spikes or protuberances arranged thereon in addition to the spacers 33 may be advantageously arranged.

The separator may be provided with a plurality of outlet orifices 10, in the event of the fluid fraction being composite and formed from a plurality of constituents of different densities.

The outlet orifice(s) may be equipped with a movable ring 35 providing same with an adjustable opening, so as to adjust the flow characteristics via the separator and particularly the flow rate thereof.

Figure 5:
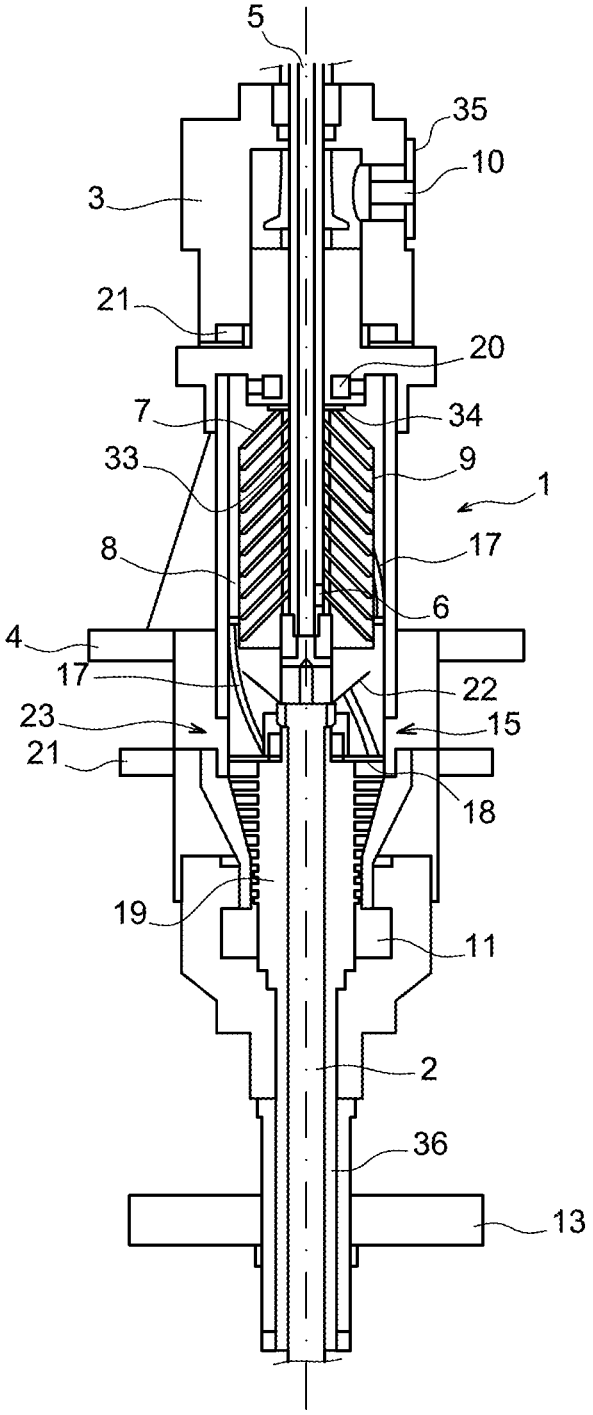

The conveying screw may become increasingly narrow in the downward direction, which is clearly represented in FIG. 5, so as to continue to increasingly compress the cake and express the residual liquid therefrom.

The scraper 15 and the conveying screw 19 may have a portion 36 fitted on the central axis 2 so as to maintain the coaxiality thereof and promote satisfactory cohesion of the separator.

It is finally advantageous that the peripheral wall 8 of the rotary bowl 1 is transparent to help monitor the completion of the method.

What is claimed is:

1. Centrifugal separator comprising a rotary bowl (1) having a peripheral wall (8), a separation structure situated in the bowl and rotating synchronously with the bowl, a mixture inlet conduit (5) situated on a rotational axis (2) of the bowl and opening (6) in the bowl, the bowl comprising at least one outlet orifice (10) for at least one light fraction of the mixture to a first axial side of the bowl, the separation structure comprising a stack of cones divided into angular sectors (7) separated by angular gaps (9), the angular gaps being covered by the sectors (7) of the immediately adjacent cones, and the sectors having peripheral ends at an identical distance from the peripheral wall, wherein the peripheral wall (8) and the separation structure rotate at a same rotary speed, and wherein the cones are separated by calibrated spacers (33).

2. Centrifugal separator according to claim 1, wherein the peripheral wall (8) is defined by a rectilinear generating line in front of the sectors (7).

3. Centrifugal separator according to claim 2, wherein the bowl is cylindrical and the cones are identical or the result of assemblies of different geometries.

4. Centrifugal separator according to claim 3, wherein the cones are successively angularly offset.

5. Centrifugal separator according to claim 1, characterised by a spring (34) between an end cone and a manifold for collecting the light fraction upstream of the outlet orifice.

6. Centrifugal separator according to claim 1, wherein the rotary bowl and the separation structure are separable.

7. Centrifugal separator comprising a rotary bowl (1) having a peripheral wall (8), a separation structure situated in the bowl and rotating synchronously with the bowl, a mixture inlet conduit (5) situated on a rotational axis (2) of the bowl and opening (6) in the bowl, the bowl comprising at least one outlet orifice (10) for at least one light fraction of the mixture to a first axial side of the bowl, the separation structure comprising a stack of cones divided into angular sectors (7) separated by angular gaps (9), the angular gaps being covered by the sectors (7) of the immediately adjacent cones, and the sectors having peripheral ends at an identical distance from the peripheral wall, wherein the peripheral wall (8) and the separation structure rotate at a same rotary speed, and wherein the sectors comprise extensions (31, 32) extending axially and radially in the rotary bowl (1) and each joining another sector belonging to an adjacent cone.

8. Centrifugal separator comprising a rotary bowl (1) having a peripheral wall (8), a separation structure situated in the bowl and rotating synchronously with the bowl, a mixture inlet conduit (5) situated on a rotational axis (2) of the bowl and opening (6) in the bowl, the bowl comprising at least one outlet orifice (10) for at least one light fraction of the mixture to a first axial side of the bowl, the separation structure comprising a stack of cones divided into angular sectors (7) separated by angular gaps (9), the angular gaps being covered by the sectors (7) of the immediately adjacent cones, and the sectors having peripheral ends at an identical distance from the peripheral wall, wherein the peripheral wall (8) and the separation structure rotate at a same rotary speed, and wherein the bowl comprises an opening (23) for retrieving a heavy fraction of the mixture, and said opening is situated via a second axial side of the bowl opposite the first axial side.

9. Centrifugal separator according to claim 8, wherein the opening (23) extends along a circumference of the bowl and is adjacent to an edge of the peripheral wall of the bowl.

10. Centrifugal separator according to claim 9, further comprising a scraper (19) comprising an inclined blade (17) through the opening (23) and extending in front of an inner face of the peripheral wall of the bowl, and transmissions (13, 14) providing a differential rotational speed between the bowl and the scraper using a single drive motor (12) equipped with a differential (26) or two separate motors (29, 30).

11. Centrifugal separator according to claim 8, further comprising a screw (19) for conveying solid fraction, situated under the opening (23) for retrieving the heavy fraction of the mixture.

12. Centrifugal separator according to claim 11, wherein the screw (19) for conveying the solid fraction is narrower at a bottom of the bowl.

13. Centrifugal separator according to claim 11, wherein the scraper (15) and the screw (19) for conveying the solid fraction have a portion (36) fitted on the rotational axis of the bowl.

14. Centrifugal separator comprising a rotary bowl (1) having a peripheral wall (8), a member (21) for supporting the rotary bowl (1), a separation structure situated in the bowl and rotating synchronously with the bowl, a mixture inlet conduit (5) situated on a rotational axis (2) of the bowl and opening (6) in the bowl, the bowl comprising at least one outlet orifice (10) for at least one light fraction of the mixture to a first axial side of the bowl, the separation structure comprising a stack of cones divided into angular sectors (7) separated by angular gaps (9), the angular gaps being covered by the sectors (7) of the immediately adjacent cones, and the sectors having peripheral ends at an identical distance from the peripheral wall, wherein the peripheral wall (8) and the separation structure rotate at a same rotary speed.

15. Centrifugal separator comprising a rotary bowl (1) having a peripheral wall (8), a separation structure situated in the bowl and rotating synchronously with the bowl, a mixture inlet conduit (5) situated on a rotational axis (2) of the bowl and opening (6) in the bowl, the bowl comprising at least one outlet orifice (10) for at least one light fraction of the mixture to a first axial side of the bowl, the separation structure comprising a stack of cones divided into angular sectors (7) separated by angular gaps (9), the angular gaps being covered by the sectors (7) of the immediately adjacent cones, and the sectors having peripheral ends at an identical distance from the peripheral wall, wherein the peripheral wall (8) and the separation structure rotate at a same rotary speed, and wherein the outlet orifice (10) has an adjustable opening.

16. Method for separating a heavy fraction and a light fraction of a mixture using a centrifugal separator comprising a rotary bowl (1) having a peripheral wall (8), a separation structure situated in the bowl and rotating synchronously with the bowl, a mixture inlet conduit (5) situated on a rotational axis (2) of the bowl and opening (6) in the bowl, the bowl comprising at least one outlet orifice (10) for at least one light fraction of the mixture to a first axial side of the bowl, the separation structure comprising a stack of cones divided into angular sectors (7) separated by angular gaps (9), the angular gaps being covered by the sectors (7) of the immediately adjacent cones, and the sectors having peripheral ends at an identical distance from the peripheral wall, the method comprising the following steps:

introducing the mixture into the rotary bowl, the bowl being rotating, via the inlet conduit;

letting the mixture flow through the gaps of the stack of cones in a spiral flow comprising a regular progressive axial motion, the flow being laminar;

discharging the light fraction of the mixture out of the bowl at the outlet orifice; and depositing the heavy fraction on the peripheral wall.

17. Separation method according to claim 16, wherein the heavy fraction progressively exits the bowl by a helical scraper rotating at a rotary speed different from a rotary speed of the bowl, the scraper being adjacent to the peripheral wall, the heavy fraction passing through the bowl at an opening provided through a bottom of the bowl.

* * * * *